US007174750B2

(12) United States Patent
Shirasaki et al.

(10) Patent No.: US 7,174,750 B2
(45) Date of Patent: Feb. 13, 2007

(54) WARP KNIT FABRIC WITH STERIC STRUCTURE

(75) Inventors: Fumio Shirasaki, Fukui (JP); Yukito Kaneko, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 10/549,397

(22) PCT Filed: Mar. 30, 2004

(86) PCT No.: PCT/JP2004/004566

§ 371 (c)(1),
(2), (4) Date: Oct. 14, 2005

(87) PCT Pub. No.: WO2004/088021

PCT Pub. Date: Oct. 14, 2004

(65) Prior Publication Data

US 2006/0172646 A1 Aug. 3, 2006

(30) Foreign Application Priority Data

Mar. 31, 2003 (JP) ..... 2003-095265

(51) Int. Cl.
*D04B 9/06* (2006.01)

(52) U.S. Cl. ..... 66/195; 66/196

(58) Field of Classification Search ..... 66/195, 66/192, 196, 193; 442/304, 312, 314
See application file for complete search history.

(56) References Cited

U.S. PATENT DOCUMENTS 4,787,219 A * 11/1988 Sato et al. ..... 66/190
5,385,036 A * 1/1995 Spillane et al. ..... 66/87
6,477,865 B1 * 11/2002 Matsumoto ..... 66/195
6,755,052 B1 * 6/2004 Sytz ..... 66/196
6,758,068 B2 * 7/2004 Shirasaki et al. ..... 66/195

FOREIGN PATENT DOCUMENTS

| | | |
|---|---|---|
| JP | 1-40135 | 8/1989 |
| JP | 2-47346 | 2/1990 |
| JP | 4-146246 | 5/1992 |
| JP | 4-222260 | 8/1992 |
| JP | 4-327259 | 11/1992 |
| JP | 9-137380 | 5/1997 |
| JP | 2001-11757 | 1/2001 |
| JP | 2003-3355 | 1/2003 |
| WO | WO- 2002/050352 | 6/2002 |

* cited by examiner

*Primary Examiner*—Danny Worrell
(74) *Attorney, Agent, or Firm*—Jordan and Hamburg LLP

(57) ABSTRACT

It is to provide a three-dimensional warp-knitted fabric in which breathability and cushioning property especially are well suited for a motor vehicle seat in a manner that a feeling of stickiness and steaminess when sweating is eliminated. The three-dimensional warp-knitted fabric comprising front and back ground structures, one of which has a smaller number of loops (1), the other ground structure having a larger number of loops (2); and connecting yarns for connecting these two ground structures (4). One of the ground structures (1) and the other ground structure (2) being knitted with different number of needles, and the number of loops of the ground structure having the smaller number of loops (1) being 30 to 75% that of the other ground structure having the larger number of loops (2). Moreover, the per-area weight of the ground structure having the small number of loops is 60 to 150% of the ground structure having the larger number of loops.

3 Claims, 5 Drawing Sheets

WARP KNIT FABRIC WITH STERIC STRUCTURE

TECHNICAL FIELD

The invention relates to a three-dimensional warp-knitted fabric having a difference in knitting density between front and back surfaces, and more specifically, to such fabric for eliminating stickiness and discomfort when the wearer is sweating, and is light-weight and superior in functionality.

BACKGROUND ART

A three-dimensional warp-knitted fabric comprised of front and back ground structures and connecting yarns has superior resiliency, cushioning properties, and breathability, is therefore used in general clothing articles, sports wear, and underwear; as well as cushioning fabric for motor vehicle seats, chairs, and beds or the like in a field of interior furnishing. For achieving comfortability and breathability in these applications, disclosed are many technologies; and one among them is as follows. Different numbers of loops are employed in the front and back ground structures of the three-dimensional warp-knitted fabric. And, patterned indented surface is provided on the ground structure having a small number of loops as to decrease the area which comes into contact with the skin, in order for improving Breathability and texture.

For forming the patterned indented surface on the three-dimensional warp-knitted fabric, disclosed is a method of forming a ribbed pattern by applying high-pressure liquid flow on the knitted fabric (JP-B-1(1989)-40135 or Japanese Examined Patent Publication No. 1-40135). There is also disclosed a method of forming the pattern by heat pressing the knitted fabric with a calendar roll or the like (JP-A-4 (1992)-146246 or Japanese. Unexamined Patent Publication No. 4-146246). In otherwise, proposed are methods such as one in which a three-dimensional pattern is formed by using thermally contracting yarns and performing heat treatment (JP-A-4(1992)-222260 and JP-A-4(1992)-327259).

However, the method of forming a ribbed pattern by the high pressure liquid flow has a problem in that it is difficult to maintain the shape of the ribbed patterns for a long time, whereas the method of heat pressing has a problem in that texture may be deteriorated by collapse of the knitted fabric or hardening of the front or back ground structure having only small numbers of loops. The method of using the thermally contracting yarns has a problem in that thickness-wise interval of the indents is relatively small and thus extent or feeling of indents on the surface is poor.

There is also a method for forming the patterned indented surface not by after-processing as above, but by pattern of knitting. For example, JP-A-9-137380 discloses a method of forming the patterned indented surface by mesh knitting, broad stitch, or tuck stitch.

However, while the patterned indented surface is surely obtained by these methods, the thickness-wise difference is relatively small, and hence the area of the projected portions which comes into contact with the skin is still large. Therefore, when it is applied to the motor vehicle's seat, it is insufficient for eliminating a feeling of stickiness or a feeling of steaminess due to sweating, for example, after seated for a long time in midsummer. Moreover, in the three-dimensional structure formed by the above-described methods, the density of kinitting, the number of loops, and intervals of loops are identical between the front and back ground structures. For this reason, sufficient effect is not achieved even when providing openings on the ground structures or when forming the indent pattern thereon by after-processing as in above.

After various investigations and trials, the inventors have found a way to solve the above described problems and to provide a three-dimensional warp-knitted fabric superior in breathability and cushioning properties, so as to complete the present invention.

In other words, it is an object of the present invention to provide a three-dimensional warp-knitted fabric which has following properties; light weight, high void ratio, high compressive elasticity, high breathability, and soft texture, as well as an agreeable structure which eliminates a feeling of being steamed and a feeling of sweating after long term use, as to be preferably used for motor vehicle's seats, chairs, and beds.

DISCLOSURE OF THE INVENTION

In order to achieve the above-described object, the invention-wise three-dimensional warp-knitted fabric including: front and back ground structures and connecting yarns for connecting the front and back ground structures; the front and back ground structures having different number of loops from each other so that the number of loops on one of the ground structures is smaller than the number of loops on the other; wherein number of loops in the ground structure having a smaller number of loops is 30 to 75% that of the ground structure with larger number of loops.

In respect, of way of knitting, the three-dimensional warp-knitted fabric is formed by knitting the ground structures with different numbers of knitting needles. In more detail, the number of knitting needles for the ground structure having the smaller number of loops is smaller than the number of knitting needles for knitting the ground structure having the larger number of loops, so that the number of loops of one of the ground structures is 30 to 75% of the number of loops of the other ground structure. The term "the number of loops" used in the present invention means the number of loops in a unit area; and more specifically, the number of loops in the area of one square inch that is drawn by one inch in the longitudinal direction and one inch in the widthwise direction of the warp-knitted fabric.

According to the invention, the number of loops of either the front or back ground structure is reduced as to broaden intervals between loops as against the other ground structure, by knitting the front and back ground structures with the different number of knitting needles as described above. Consequently, breathability is improved, and in addition, the contact area on the side of the ground structure having smaller number of loops is reduced, as to enhance comfortable feeling when used in motor vehicle seats, chairs, and beds.

In other words, according to the three-dimensional warp-knitted fabric of the present invention, since the from or back surface comprises a ground structure having the smaller number of loops than the other ground structure, breathability is improved significantly, compared with the conventional three-dimensional warp-knitted fabrics, in which number of loops is same between the front and back ground structures. Because the number of loops per unit area on one of the ground structures is smaller, area contacting with a human body (surface of the skin) become smaller, even when number of loops of the other ground structure is same with that in the conventional three-dimensional warp-knitted fabrics. In other words, since the area contacting with the skin is reduced, the texture is improved and stickiness is prevented when sweating. In particular, when it is applied to a motor vehicle seat, the sense of discomfort is eliminated.

According to the three-dimensional warp-knitted fabric of the present invention, since the front or back ground structure comprises a ground structure having a smaller number of loops, the per-area weight of the entire knitted fabric may be reduced in comparison with the one formed with the front and back ground structures having the same number of loops, and hence light weight may be achieved. In addition, since number of the connecting yarns may be reduced as a result of reduced number of loops on one of the ground structures, constraint by the connecting yarns on one of the ground structures become weaker; and hence easiness of shaping or forming, which is required when used for the motor vehicle's seat, is improved.

The reason why the ratio of the number of loops on the side, the front surface or the back surface, having the smaller number of loops in the ground structure with respect to the side having the larger number of loops is set to 30 to 75% is as follows. If the number of loops on the side having the smaller number of loops is less than 30% of the side having the larger number of loops, the compression resistance and cushioning properties may be lowered. And, if it exceeds 75%, the above-mentioned advantageous effects may not be obtained sufficiently. In respect of such advantageous effects, the preferable range of the ratio of the number of loops is 45 to 60%.

In the above-described three-dimensional warp-knitted fabrics, the ground structure having the larger number of loops may be of plain pattern while the ground structure having the smaller number of loops is of a meshwork pattern. In this way, although one side is plain, the contact area is reduced on the side of the meshwork pattern, and hence breathability and amenity are significantly improved.

In the three-dimensional warp-knitted fabric in each of the above-mentioned aspects, it is especially preferable that weight per area on the ground structure having smaller number of loops is 60% to 150% of that of the ground structure having the larger number of loop. When ratio of the weight per area between the ground structures is smaller than the above range, the surface strength such as abrasion resistance become insufficient; and when the ratio become larger than the above range, there arises a problem in breathability and texture.

The three-dimensional warp-knitted fabric of the present invention is not specifically limited and may be warp knit, circular knit, or textile. However, double raschel is preferred since it is superior in cushioning property and shape retaining property. Filaments constituting the ground structures are not limited and may be multi-filament or monofilament. The form of the yarn is not specifically limited and may be a covering yarn, contracting yarn, or crimped yarn having sheath-core structure.

Though the connecting yarn is also not specifically limited, monofilament is preferable in terms of cushioning property. The connecting yarn may be formed of natural fiber, recycled fiber, semi-synthetic fiber, synthetic fiber or a combination thereof. However, synthetic fibers are preferred in terms of cushioning property and abrasion resistance. Among these, polyester fiber having superior durability is preferred when the fabric is used for interior articles for motor vehicles.

Meanwhile, the front and background structures are formed of yarns of synthetic fiber, preferably of polyester fiber. Fineness of the yarns is preferably from 84 to 660 decitex, in view of thickness, breathability, and rigidity of the fabric. When the fineness of the yarns is lower than 84 decitex, the surface strength (abrasion resistance and the like) of the ground structure having the smaller number of loops may not be sufficient. When the fineness exceeds 660 decitex, feel of the fabric on the skin may be deteriorated.

The number of knitting needles of the knitting machine is preferably from 16 to 30 per inch, in view of thickness, breathability, and rigidity of the fabric as in above.

BEST MODE FOR CARRYING OUT THE INVENTION

Figure 1:
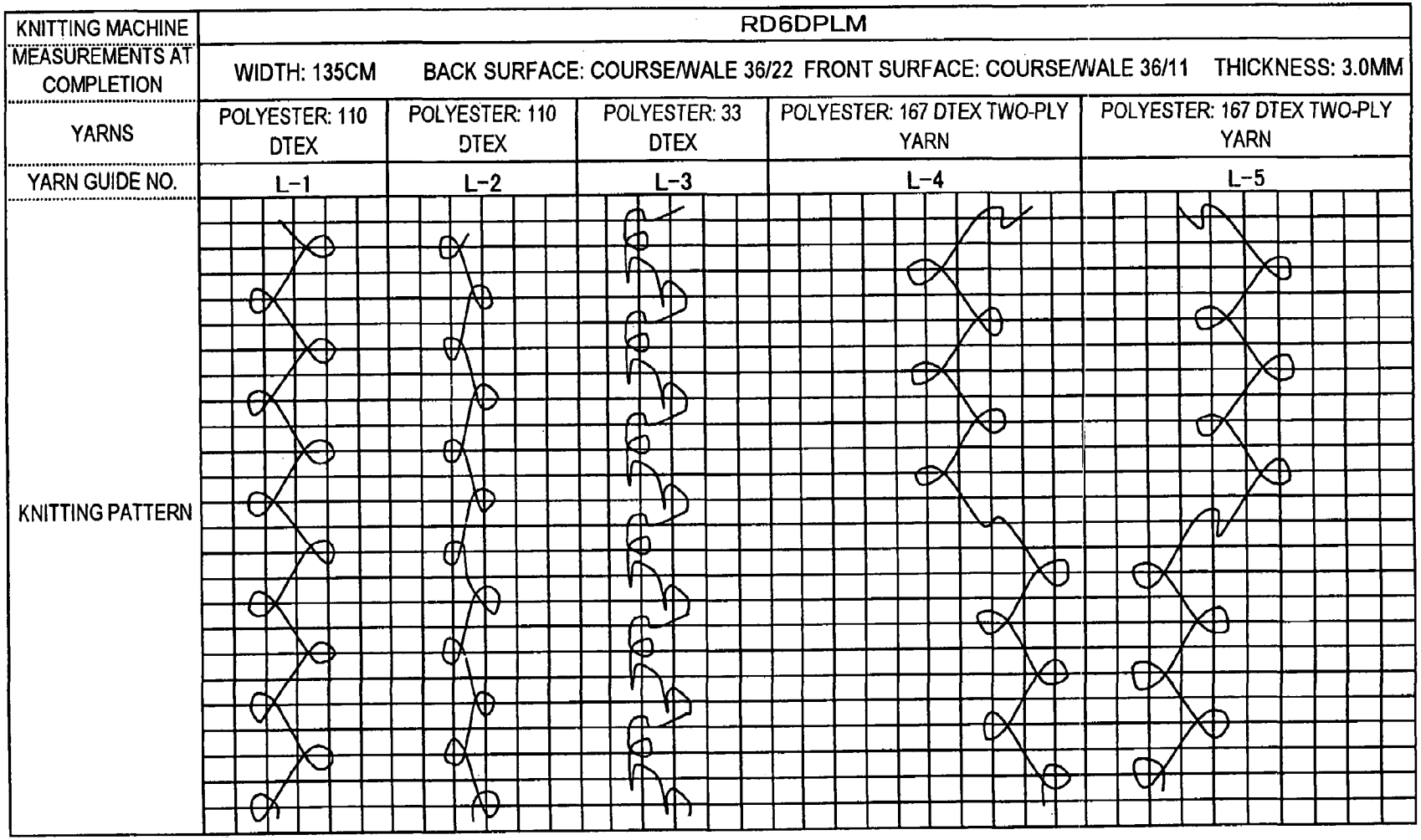
FIG. 1 is a knitting pattern of Example 1 of the invention.
Figure 2:
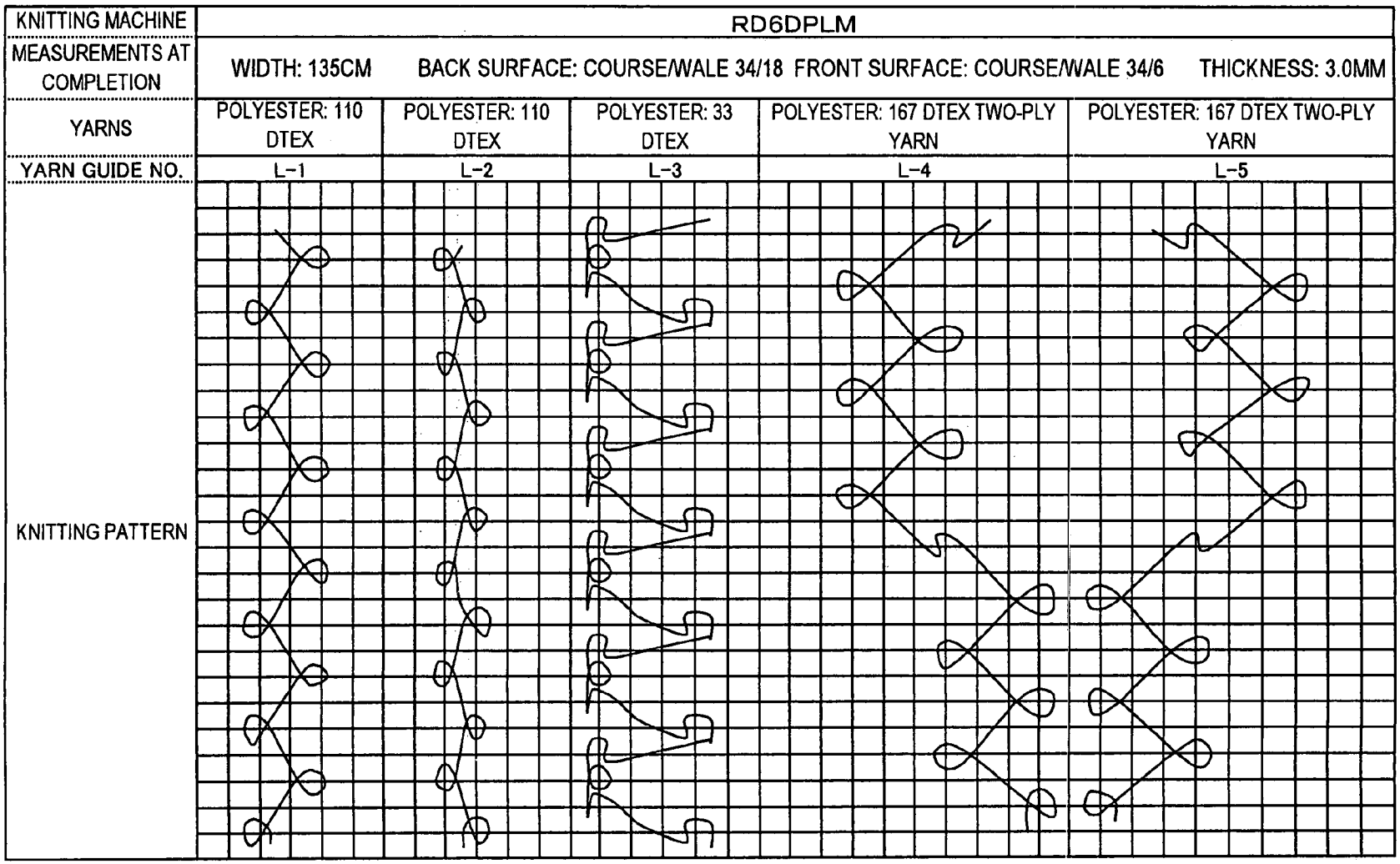
FIG. 2 is a knitting pattern of Example 2 of the invention.
Figure 3:
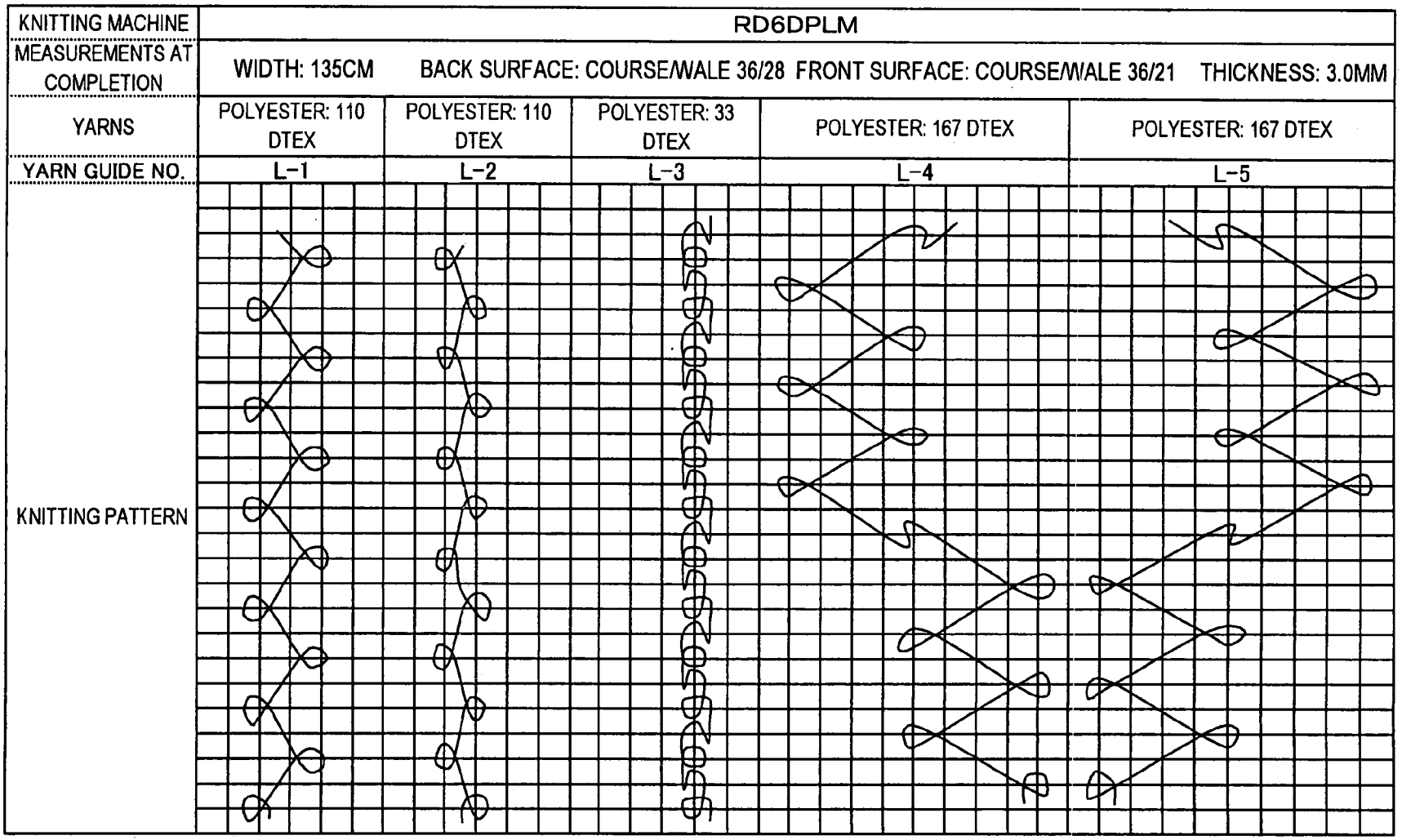
FIG. 3 is a knitting pattern of Example 3 of the invention.

A three-dimensional warp-knitted fabric according to the present invention is knitted as shown in the knitting pattern in FIG. 1 to FIG. 3 using a warp-knitting machine having a two-row needle bed such as a double raschel machine.

In the knitting pattern of FIG. 1 to FIG. 3, yarns passed through a yarn guide L4 and a yarn guide L5 form the ground structure on either of the front or back surfaces, which is the ground structure having the smaller number of loops (or the ground structure having the larger number of loops). Yarns passed through a yarn guide L1 and a yarn guide L2 form a ground structure on the other surface, which is the ground structure having the larger number of loops (or the ground structure having the smaller number of loops). These front and back ground structures are connected by yarns (connecting yarns) passed through a yarn guide L3, as to form a three-dimensional textile structure, namely the three-dimensional warp-knitted fabric.

The yarns-passed through the yarn guides L4, L5 (or L1, L2) forming the front or back ground structure are knitted as shown in the drawing, and the yarns of the yarn guides L4 and L5 are knitted with some guide needles having no yarns passed therethrough. The ground structure is formed into a structure having openings, that is, into a meshed structure to provide the openings. On the other hand, the yarns passed through the yarn guides L1, L2 (or L4, L5) forming the ground structure on the other side are passed through with the full setting to form a plain structure as shown in the drawing.

Figure 5:
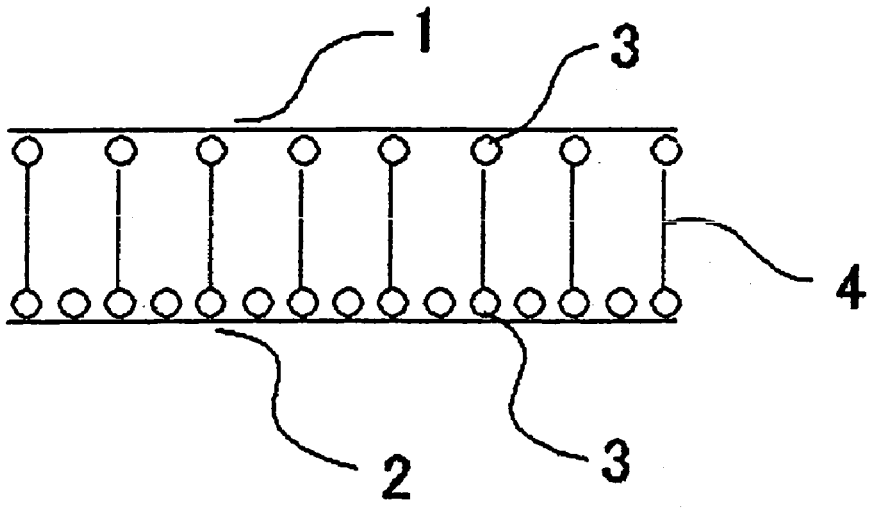
FIG. 5 is a schematic cross-sectional view of a three-dimensional warp-knitted fabric according to the invention, which has different numbers of loops in front and back ground structures.

By such knitting, number of loops on either of the front or the back ground structure becomes smaller than that on other ground structure. For example, as shown in FIG. 5, the number of loops 3 of the front ground structure is smaller than that of the back ground structure of plain stitch, as to provide different numbers of loops on the front and back ground structures 1, 2 in a three-dimensional warp-knitted fabric. Reference numeral 4 in the drawing designates connecting yarns.

In such three-dimensional warp-knitted fabric, the number of loops on the ground structure having smaller number of the loops, on front or back side, is particularly set to be 30 to 75% of the number of loops of the other ground structure having the larger number of loops, according to the invention.

Such setting of the ratio of the numbers of loops of the front and back ground structures is achieved by broadening the intervals between the yarns passed through the yarn guides L4, L5 (or L1, L2) for knitting the ground structure of smaller number of loops, in comparison with the intervals of the yarns passed through the yarn guides L1, L2 (or L4, L5) for knitting the other ground structure, as to decrease the number of yarns used by not supplying yarns to some of the guide needles of the guides. In other words, number of knitting needles used are set as different between the front and back ground structures, by setting ratio of the numbers of the knitting needles at some appropriate value, as to achieve above range of the ratio of the number of loops. In the example shown in FIG. 5, the number of loops 3 on the front ground structure 1 is about 50% of that on the back ground structure 2. Thus, the intervals in wale direction between loops 3 on the ground structure 1 are larger than that on the back ground structure 2.

Figure 6:
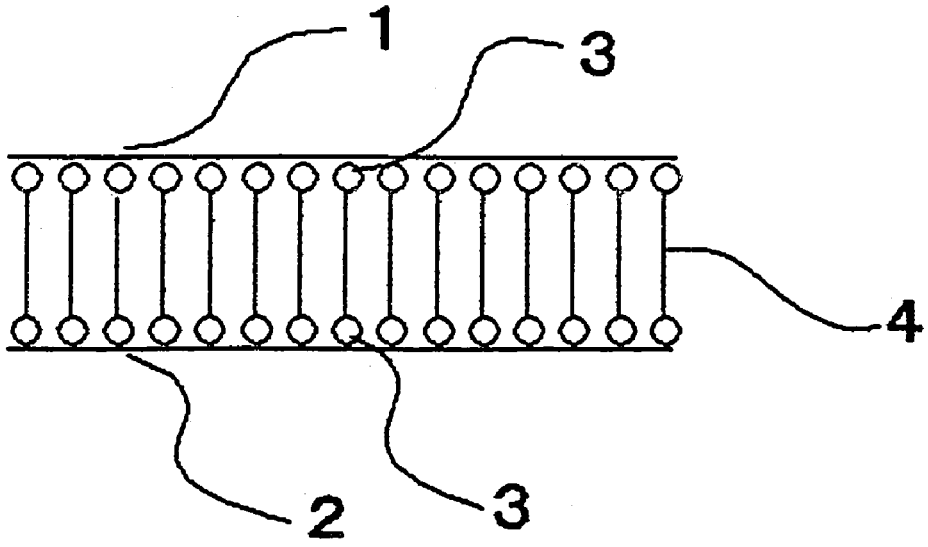
FIG. 6 is a schematic cross-sectional view of a conventional three-dimensional warp-knitted fabric having the same number of loops on the front and back ground structures.

A three-dimensional warp-knitted fabric in general, for instance of the double raschel, has by its nature good breathability since it is comprised of the front and back ground structures and the connecting yarns for connecting the ground structures as to have voids in a textile structure. However, when the numbers of the loops 3 on the front and back ground structures are the same as in the prior art shown in FIG. 6, the knitting density is high both on the front and back ground structures and hence the weight increases correspondingly, and in addition, breathability is suppressed. Therefore, when it is used for a motor vehicle seat, for example, it comes into tight contact with the skin, thereby likely causing a feeling of steaminess or of stickiness.

In contrast, according to the invention, number of loops on either of the front and back ground structures is smaller than that in the prior art to make the contact area smaller. Thus, the three-dimensional warp-knitted fabric does not readily come into tight contact with the skin; and hence breathability is improved, and the effect to prevent the feeling of steaminess or of stickiness becomes more remarkable.

In the three-dimensional warp-knitted fabric of the present invention, even when the connecting yarns are collapsed, voids in the fabric are maintained to some extent, since the intervals between loops are broadened on the ground structure having a small number of loops, that is, on the side of the ground structure having a smaller knitting density. Therefore, passages for air flow are achieved, and hence the fabric becomes comfortable as to restrain steaminess to persons in contact with. In addition, since the number of loops on one of the ground structures is smaller, constraint by the connecting yarns are rather weak, and the easiness of shaping upon usage is improved correspondingly.

The three-dimensional warp-knitted fabric of the invention may be used for beddings such as sheets and beds, as well as interior materials such as the vehicle's seats or chairs, by taking advantage of its superior breathability and feeling to the skin. The fabric of the invention may also be used in other various applications. Although description will be made below with examples, the invention is not limited to these examples, and may be applied to any other mode of embodiment.

The present invention will be explained by use of the examples, in which evaluation methods at below are adopted.

Breathability

Test procedures were in accordance with JIS L 1018 6.34 "a method of evaluating breathability". The larger number of test result represents higher breathability.

Contact Area

The fabric (three-dimensional warp-knitted fabric) to be evaluated is cut into a size of 7 cm×7 cm. Ink of stamp pad (of Shachihata Co., Japan) was applied all over the surface of the ground structure having the smaller number of loops (surface having the openings) and a white paper was placed thereon. Then, a cylindrical weight of 7 cm in diameter and 5 kg in weight was placed thereon, and left to stand for 10 seconds. Then, the white paper is removed from the fabric, and trimmed into the size of 5 cm×5 cm, and the surface area of ink (contact surface) on the white paper was measured. Measurement of the area is made as follows. The paper of 5 cm×5 cm is scanned by a scanner to be read into a personal computer. Then binarization is made in respect of the colors of the ink and of the white paper; and total number of ink-color dots are counted by integration calculation. The ratio of the contact surface was calculated by the following equation. The smaller number represents smaller contact surface, and hence less stickiness.

$$\text{Contact surface ratio}(\%)=\text{ink-attaching area}/\text{white-paper area}\times 100$$

Thickness Retention

The fabric (three-dimensional warp-knitted fabric) to be evaluated was cut into pieces of 7 cm×7 cm and four pieces of them are stacked and laminated so that the change in thickness is more easily recognized. Then, the cylindrical weight of 7 cm in diameter and 5 kg in weight was placed thereon, and left to stand for 2 hours at 100° C. so as to make change in thickness more prominent. The weight is removed at two hours later. Thickness retention is calculated by following equation, where T2 represents the thickness immediately after the weight was removed and T1 represents the thickness before placing the weight. The larger number represents better compression resistance.

$$\text{Thickness Retention}(\%)=T2/T1\times 100$$

EXAMPLE 1

A warp-knitting machine (RD6DPLM) of Mayer Co. is used. The ground structure having the larger number of loops was knitted using 22 knitting needles per inch. The ground structure having the smaller number of loops and having openings of a meshwork was knitted using 11 knitting needles per inch. The two ground structures were connected by connecting yarns, as to form a three-dimensional warp-knitted fabric in accordance with a knitting pattern shown in FIG. 1. The thickness of the warp-knitted fabric was 3.0 mm; and the knitting density per inch of the ground structure having the larger number of loops at completion of the knitting was 36 courses and 22 wales; and the knitting density per inch of the ground structure having the smaller number of loops was 36 courses and 11 wales at completion of the knitting. The per-area weight of the ground structure having the smaller number of loops was 150 g/m$^2$; the per-area weight of the ground structure having the larger number of loops, was 210 g/m$^2$; the ratio of the per-area weight of the ground structure having the smaller number of loops with respect to the ground structure having the larger number of loops was 71%; and the sum of the per-area weight was 360 g/m$^2$. The number of loops of the ground structure having the larger number of loops was 22×36=792/inch$^2$, and the number of loops of the ground structure having the smaller number of loops was 11×36=396/inch$^2$. The ratio of the number of loops of the ground structure having the smaller number of loops with respect to the number of loops of the ground structure having the large number of loops was 50%. The results of evaluation of this warp-knitted fabric are shown in Table 1.

EXAMPLE 2

The warp-knitting machine (RD6DPLM) of Mayer Co. was used. The ground structure having the larger number of loops was, knitted using 18 knitting needles per inch, and the ground structure having the smaller number of loops and having openings of a meshwork was knitted using 6 knitting needles per inch. Both of these ground structures were connected by connecting yarns to form the three-dimensional warp-knitted fabric in accordance with a knitting pattern shown in FIG. 2. The thickness of the warp-knitted fabric was 3.0 mm; and the knitting density per inch of the ground structure having the larger number of loops was 34 courses and 18 wales at completion of the knitting; and the knitting density per inch of the ground structure having the smaller number of loops was 34 courses and 6 wales at completion of the knitting. The per-area weight of the ground structure having the smaller number of loops was 110 g/m$^2$; the per-area weight of the ground structure having the larger number of loops was 130 g/m$^2$; the ratio of the per-area weight of the ground structure having the smaller number of loops to that of the ground structure having the larger number of loops was 84%; and the sum of the per-area weights was 240 g/m$^2$. The number of loops of the ground structure having the larger number of loops was 18×34=612/inch$^2$; and the number of loops of the grounds structure having the smaller number of loops was 6×34=204/inch$^2$. The ratio of the number of loops of the ground structure having the smaller number of loops to the number of loops of the ground structure having the large number of loops was 33.3%. The results of evaluation of this warp-knitted fabric are shown in Table 1.

EXAMPLE 3

The warp-knitting machine (RD6DPLM) of Mayer Co. is used. A ground structure having the larger number of loops was knitted using 28 knitting needles per inch; and a ground structure having the smaller number of loops having openings of a meshwork was knitted using 21 knitting needles per inch. Both of these ground structures were connected by connecting yarns to form a three-dimensional warp-knitted fabric in accordance with a knitting pattern shown in FIG. 3. The thickness of the warp-knitted fabric was 3.0 mm; and the knitting density per inch of the ground structure having the larger number of loops was 36 courses and 28 wales at completion of the knitting; and the knitting density per inch of the ground structure having the smaller number of loops was 36 courses and 21 wales at completion of the knitting. The per-area weight of the ground structure having the smaller number of loops was 190 g/m$^2$; the per-area weight of the ground structure having the larger number of loops was 210 g/m$^2$; the ratio of the per-area weight of the ground structure having the smaller number of loops with respect to the ground structure having the larger number of loops was 90%; and the sum of the per-area weights was 400 g/m$^2$. The number of loops of the ground structure having the larger number of loops was 28×36=1008/inch$^2$; and the number of loops of the ground structure having the smaller number of loops was 21×36=756/inch$^2$. The ratio of the number of loops of the ground structure having the smaller number of loops to the number of loops of the ground structure having the large number of loops was 75%. Evaluation results of this warp-knitted fabric are shown in Table 1.

COMPARATIVE EXAMPLE 1

Figure 4:
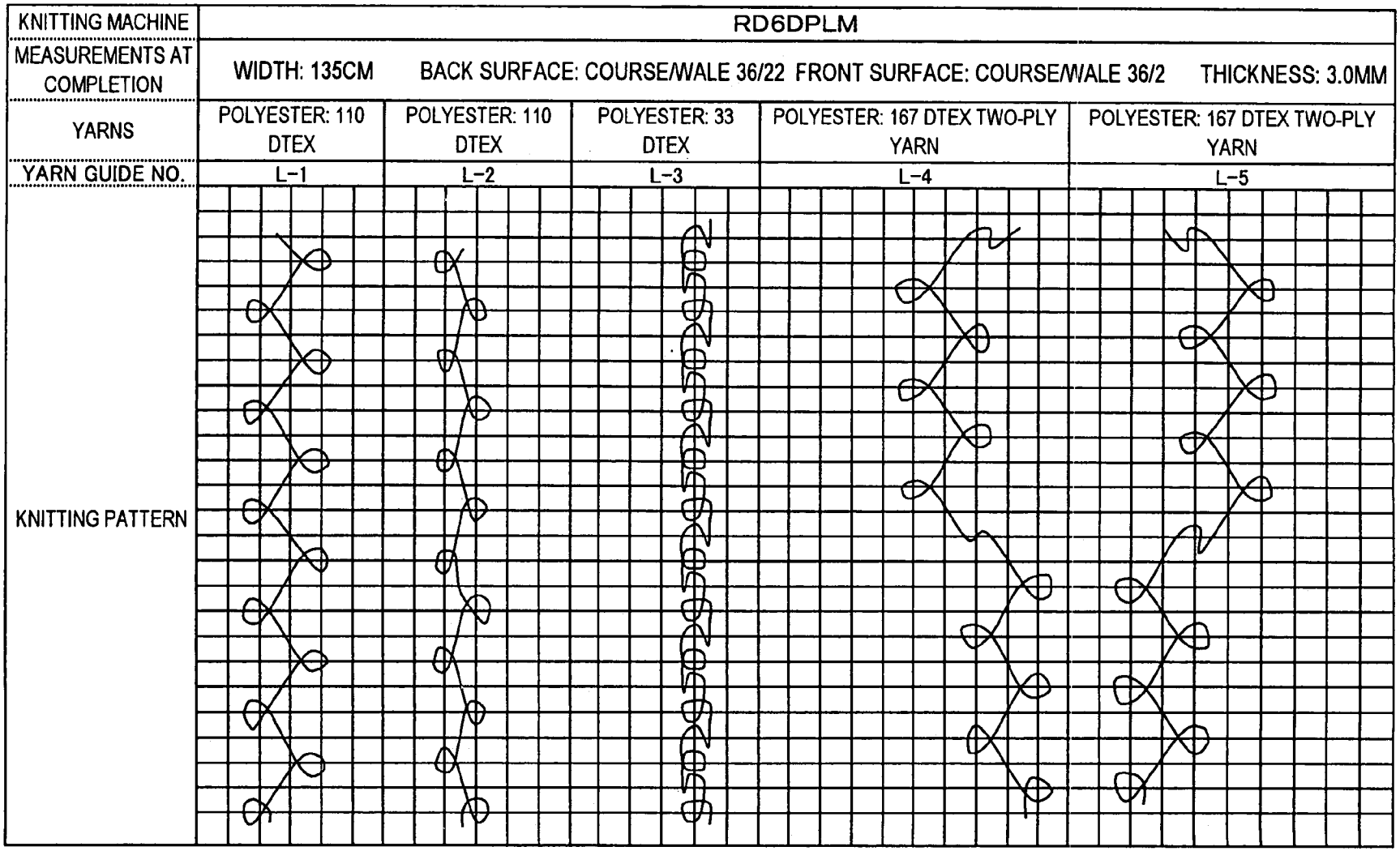
FIG. 4 is a knitting pattern of Comparative Example 1.

Using the warp-knitting machine (RD6DPLM) from Mayer, front and back ground structures were knitted using 22 knitting needles per inch, and both of these ground structures were connected by a connecting yarn to form a three-dimensional warp-knitted fabric having a structure shown in FIG. 4. The thickness of the warp-knitted fabric was 3.0 mm, and the finished density was 36 courses, 22 wales for both of the front and back ground structures. The per-area weight of the ground structures having openings of a meshwork was 300 g/m$^2$; the per-area weight of the ground structure of plain knitting was 150 g/m$^2$; the ratio of the per-area weight of the plain knitting ground structure to that of the ground structure having meshwork openings was 200%; and the sum of the per-area weights was 450 g/m$^2$. The number of loops on the front and back ground structures were both 22 ×36=792/inch$^2$. Evaluation results of this fabric are also shown in Table 1.

TABLE 1

| | Examples | | | Comparative Example |
|---|---|---|---|---|
| | 1 | 2 | 3 | 1 |
| Ratio of number of loops (%) | 50 | 33.3 | 75 | 100 |
| Ratio of per-area weight (%) | 71 | 84 | 90 | 200 |
| Thickness Retention (%) | 83 | 78 | 88 | 85 |
| Ratio of Contact Surface (%) | 19.6 | 10.3 | 23.7 | 33.7 |
| Breathability | 250 | 283 | 233 | 175 |

According to the result shown in Table 1, the ratio of per-area weight and the ratio of contact surface of the ground structure having the smaller number of loops were smaller in Examples 1–3 of the invention in comparison with the Comparative Example 1. In each Example, the breathability was good and thickness retentions was not inferior to Comparative Example 1. In this way, the above-mentioned advantageous effects and mechanism of the invention were shown by the Examples.

INDUSTRIAL APPLICABILITY

The three-dimensional warp-knitted fabric of the present invention is preferably used for beddings such as sheets and beds, as well as for interior articles such as vehicle's seats or chairs, and may also be used in a variety of other applications, by taking advantage of its superior breathability and feel to the skin.

The invention claimed is:

1. A three-dimensional warp-knitted fabric comprising:

front and back ground structures; and connecting yarns for connecting the front and back ground structures, the front and back ground structures having different numbers of loops so that the number of loops of either the front or back ground structure is smaller than the number of loops in the other ground structure, wherein one ground structure and the other ground structure are knitted with different number of knitting needles, so that intervals between loops in either the front or back ground structure with the reduced number of loops are broadened as against the other ground structure, and so that the number of loops in the ground structure having a smaller number of loops is 30 to 75% of the number of loops in the ground structure having a larger number of loops.

2. A three-dimensional warp-knitted fabric according to claim 1, wherein the ground structure having a larger number of loops is plain-stitch knitted and the ground structure on the side having a smaller number of loops is knitted in a pattern of a meshwork.

3. A three-dimensional warp-knitted fabric according to claim 1 or 2, wherein the per-area weight of the ground structure having the smaller number of loops is 60% to 150% that of the ground structure having the larger number of loops.

* * * * *